US006998374B2

(12) United States Patent
Niedbala et al.

(10) Patent No.: US 6,998,374 B2
(45) Date of Patent: Feb. 14, 2006

(54) COMPOSITION AND METHOD FOR CLEANING GELATIN ENCAPSULATED PRODUCTS COMPRISING A NON-VOLATILE SILICONE/VOLATILE SILICONE MIXTURE

(76) Inventors: Carl Niedbala, 4093 Maulfair Dr., Allentown, PA (US) 18103; R. Sam Niedbala, 4093 Maulfair Dr., Allentown, PA (US) 18103

( * ) Notice: Subject to any disclaimer, the term of this patent is extended or adjusted under 35 U.S.C. 154(b) by 9 days.

(21) Appl. No.: 10/866,033

(22) Filed: Jun. 14, 2004

(65) Prior Publication Data

US 2005/0277574 A1 Dec. 15, 2005

(51) Int. Cl.
*C11D 3/43* (2006.01)
*C11D 9/36* (2006.01)

(52) U.S. Cl. ..... 510/157; 510/201; 510/244; 510/271; 510/365; 510/407; 510/432; 510/466

(58) Field of Classification Search ..... 510/157, 510/201, 244, 271, 365, 407, 432, 466
See application file for complete search history.

(56) References Cited

U.S. PATENT DOCUMENTS

| | | | | |
|---|---|---|---|---|
| 4,634,606 | A | 1/1987 | Skogg | |
| 4,656,092 | A | 4/1987 | Haman et al. | |
| 4,686,905 | A | 8/1987 | Szabo | |
| 4,956,170 | A * | 9/1990 | Lee | 514/772.1 |
| 5,009,165 | A | 4/1991 | Morris | |
| 5,254,379 | A | 10/1993 | Kotsiopoulos et al. | |
| 5,353,712 | A | 10/1994 | Olson | |
| 5,393,054 | A | 2/1995 | Rouffer | |
| 5,447,645 | A | 9/1995 | Marshall | |
| 5,448,951 | A | 9/1995 | Olson | |
| 5,639,526 | A | 6/1997 | Kotsiopoulos et al. | |
| 5,640,945 | A | 6/1997 | Slonaker et al. | |
| 5,885,671 | A | 3/1999 | Bayless et al. | |
| 5,936,190 | A | 8/1999 | Buzick | |
| 6,210,709 | B1 | 4/2001 | Laba et al. | |
| 6,230,630 | B1 | 5/2001 | Gibson et al. | |
| 6,306,913 | B1 | 10/2001 | Hayes et al. | |
| 6,352,032 | B1 | 3/2002 | Pinney | |
| 6,375,981 | B1 | 4/2002 | Gilleland et al. | |
| 6,393,992 | B1 | 5/2002 | Vasel et al. | |
| 6,530,962 | B1 | 3/2003 | Stolz | |
| 6,532,947 | B1 | 3/2003 | Rosa et al. | |
| 6,546,874 | B2 | 4/2003 | Vasel et al. | |
| 6,675,789 | B2 | 1/2004 | Pearce et al. | |
| 2001/0045173 | A1 | 11/2001 | Gibson et al. | |
| 2002/0129728 | A1 | 9/2002 | Vasel et al. | |

OTHER PUBLICATIONS

Chopra, Ravi, "Pro-Clean Barrel Cleaner," *Action Pursuit Games*, Ravi Chopra, Oct. 1996.

* cited by examiner

*Primary Examiner*—Charles Boyer
(74) *Attorney, Agent, or Firm*—Nixon Peabody, LLP

(57) ABSTRACT

A composition and method is provided capable of removing contaminants from the surface of a gelatin capsule, such as a paint ball, to allow the gelatin capsules to be used for their intended use. The composition comprising, by weight, about 70 to 99.9 percent of a water-soluble alcohol, about 0.1 to 30 percent water, about 0.1 to 10 percent of a volatile silicone, and about 0.1 to 1 percent of a non-volatile silicone. Furthermore, the composition prevents excessive swelling of the gelatin outer shell of the gelatin encapsulated product. A method is also provided for cleaning a gelatin encapsulated product comprising the steps of contacting the gelatin encapsulated product with a cleaning composition, separating the gelatin encapsulated product from the cleaner, and drying the gelatin encapsulated product. The gelatin capsule may be a paintball. The composition may include additives to improve the performance of the gelatin capsules.

27 Claims, 8 Drawing Sheets

COMPOSITION AND METHOD FOR CLEANING GELATIN ENCAPSULATED PRODUCTS COMPRISING A NON-VOLATILE SILICONE/VOLATILE SILICONE MIXTURE

FIELD OF THE INVENTION

The invention relates generally to a composition and method for cleaning gelatin capsules. The compositions and methods of the present invention are effective for cleaning impurities or contaminants found on the surfaces of the gelatin capsules to enable the gelatin capsules to be used for their intended purposes without being impeded by such impurities or contaminants.

BACKGROUND OF THE INVENTION

Gelatin capsules have many common uses. For example, gelatin capsules are widely utilized in the pharmaceutical industry, in war games, in bath products, as well as other industrial applications. In the pharmaceutical industry, gelatin capsules may be used as time release or controlled release capsules. These capsules typically contain various pharmaceutical products encased within a gelatin shell and are intended to be taken orally. These pharmaceutical products may include medications, vitamins, dietary supplements, etc. Because gelatin capsules are water soluble, the gelatin shell, depending on its formulation, dissolves within the recipient's body over a period of time, thereby releasing the product. Different formulations of the gelatin shell may alter the rate at which the gelatin dissolves, thereby also altering the rate at which the product is released.

Another common use of gelatin capsules is for war games. Generally, police and military training and mock war games are conducted using compressed gas guns which fire projectiles, such as paint balls. (For example, see U.S. Pat. No. 5,393,054 to Rouffer and U.S. Pat. No. 5,639,526 to Kotsiopoulos et al.). The object of this type of warfare is to "hit" a target, usually an opponent, with a paint ball to thereby "kill" the opposing player. Traditionally, the shell of the paint ball is formed of a gelatin shell similar to that used to encase the pharmaceutical capsules described above. As is the case with the oral capsules, these gelatin shell paint balls are soluble in water. Upon striking the target, a paint ball that functions as intended fractures upon impact with the target, thereby releasing its contents.

While these gelatin shell projectiles are traditionally termed paint balls, the agent within the paint ball shell need not necessarily be a paint. Because of the wide variety of possible uses of paint balls in both the game of paintball and in military and law enforcement operations, the gelatin capsules may contain paints, dyes, inhibiting substances, compressed gases, and any other substances suitable for their intended purposes.

When playing a war game such as paintball, the object is to mark the target with a colored mark to indicate that the target has been hit. Typically, the colored mark will be made with a coloring agent such as a paint or dye, and is intended to be temporary. Thus, to ensure removal of the colored marks left by the paint balls from the skin and clothes of a victim, the coloring agent should exhibit good skin and fabric fugitivity. To this end, various compositions may be encased within the gelatin shell including water soluble vegetable dyes and paint formulations. Pigments are also frequently added to increase the opacity of the mark left by the breaking paint ball.

The compositions of marking colorants for use in paint balls can include substances such as ethylene glycol, polyethylene glycol, propylene glycol, polyoxyalkylene, starches, starch derivatives, glycerol, ethoxylated mono- and digylcerides, carboxylic copolymers, lilophilic carriers, nonionic polyoxyethylene derivatives of fatty acid partial esters of sorbitol anhydride, oils, and oil based paints, emulsifiers, dyes, water, and any other suitable substances.

When used in military operations or law enforcement, gelatin capsules may contain different types of substances in addition to the above described coloring agents. (For example, see U.S. Pat. No. 6,546,874 to Vasel et al. and U.S. Pat. No. 6,352,032 issued to Pinney). For these applications, it may be desirable to disable the target instead of merely marking them with a coloring agent. In this case, the gelatin capsules may contain inhibiting substances, such as oleoresin capsicum, pepper sprays, or malodorant compositions, compressed gases, such as tear gas, inert substances, such as talcum, lead shot, sand, or glass beads, skin irritants, transdermal drugs, water, infrared or ultraviolet detectable substances, or any other suitable substances or combinations thereof. Oleoresin capsicum is a safe and effective non-lethal weapon used by military and law enforcement and is comprised of a variety of chili peppers, extraction of the dried ripe fruits of capsicums, and a complex mixture of highly potent organic compounds. Another example of a possible composition for use in a gelatin capsule shell is a combination of oleoresin capsicum, and/or other inhibiting substances, and a colored dye, and/or other marking substances, to simultaneously incapacitate and mark the target.

Because of the diversity of uses of gelatin capsules, the gelatin shells of the gelatin capsules may be formed of many different compositions, such as gelatin, a thermoplastic linear polymer, such as polystyrene, environmentally degradable additives, such as photo-degradable additives, sorbitol, glycerine, starch, colorants, and water. Any other suitable components may also be used in the shell.

Paint balls and other gelatin capsules may be stored and transported in large numbers. It is not uncommon to purchase a bag or box containing thousands of gelatin capsules. A common problem with shipping and storing gelatin capsules in this way is that the breakage of a single gelatin capsule within a bag or container of many capsules can contaminate all other capsules.

During storage, shipment or bulk production, one or more of the capsules may burst within a storage container, thereby releasing its contents. In the case of paint balls, the bursting of even a single paint ball can cause a large number of the other commonly stored paint balls to become coated with the marking colorant or other substance previously stored within the broken paint ball. Since the broken paint ball may not be discovered for a significant amount of time if the breakage occurs during storage or shipment, the paint or other substance may dry onto the other paint balls. This can result in large numbers of paint balls being fused together with the dried paint, and at a minimum, causes each of the paint balls to have its gelatin shell contaminated with clumps of dried paint. The effect is to change the surface characteristics of the paintballs rendering them useless unless cleaned.

The marred surface by contaminants, such as dirt, coloring agents, or any other substances, greatly dimishes the utility of the gelatin capsule. Even without having surface contaminants, paint balls already suffer from inaccuracy, especially when launched from a distance from the target. Paint balls tend to be slightly out of round due to inherent manufacturing difficulties and the effects of gravity. Even when precise manufacturing techniques are employed, known gelatin shell paint balls are rarely, if ever, perfectly spherical. Even small degrees of misshapenness can later affect the flight of a paint ball.

If paint from a broken paint ball is dried on the surface of a paint ball, a number of problems can result. In addition to creating inaccuracies in flight, the dried paint may cause the paint ball to become lodged within the paint ball firing chamber or barrel which are part of a typical paint ball gun. Additionally, such contaminants and misshapenness can impede the handling of the paint ball through automatic loaders on rapid fire compressed gas paint ball guns. The paint ball can become lodged in the automatic loaders, or can become lodged in the barrel of the gun itself. If a paint ball becomes lodged in either place, the paint ball may either impede the firing of other balls or may break within the hopper or barrel of the gun. If this occurs, the operator of the gun will be forced to stop firing to clean out the broken or damaged paint ball, thereby causing himself to be defenseless. This and other problems can result from contaminants on the surface of a gelatin capsule. If this occurs within a container containing large numbers of paint balls or other gelatin capsules, every paint ball or gelatin capsule exposed to the contents of the broken ball must be laboriously cleaned or the entire shipment must be destroyed.

Because of the solubility or swellability of gelatin capsules in water, the cleaning of gelatin capsules which have been exposed to contaminants is extremely difficult. The water solubility or swellability of gelatin capsules has both a positive and negative impact of the utility of gelatin capsules. For example, it is desirable in both the pharmaceutical uses and in the war games and paint ball uses for the gelatin capsules to dissolve after being consumed or impacting the target, respectively. If the gelatin shell of a pharmaceutical gelatin capsule didn't dissolve, the patient may not receive the medications contained therein. In war games, after the gelatin capsules is fired and impacts the target, it is desirable for the gelatin shell to dissolve over time to prevent environmental waste.

However, the water soluble properties of gelatin capsules can also present significant problems. For example, gelatin capsule remains are exceedingly vulnerable to the vagaries of external environments. Rain, sweat from a user's body, and even high humidity often alter or even damage the gelatin shell of the gelatin capsules, thereby impacting its effective use for its intended purpose. For example, prolonged exposure to water can cause the gelatin shell of the gelatin capsule to swell, thereby altering its shape and increasing its diameter. In the case of paint balls, excessive swelling greatly impedes its functionality. For example, when being used in a paint ball gun, a swollen paint ball may become lodged in the automatic feeder or in the barrel, leading to the same problems encountered with the contaminated paint ball described above. Therefore, gelatin capsules cannot be cleaned by merely soaking them in a water based cleaner. Thus, to clean large numbers of contaminated paint balls, it is necessary to clean the paint balls individually and rapidly to prevent extended exposure of the paint balls to water.

Thus, there is a need for a composition and method capable of removing contaminants from the surface of the gelatin shells or gelatin capsules and restore them to their original condition and intended use. Furthermore, there is a need for a composition and method that is capable of cleaning a large number of gelatin capsules simultaneously while not causing any of the gelatin capsules to excessively swell. This invention answers that need.

SUMMARY OF INVENTION

It is therefore an object of the present invention to provide a composition and method capable of removing contaminants from the surface of gelatin shells of gelatin capsules to restore the gelatin capsules to their original condition to allow the gelatin capsules to be used for their intended use.

It is also an object of the present invention to provide a composition and method that is capable of cleaning a large number of gelatin capsules simultaneously while not causing any of the gelatin capsules to excessively swell.

One aspect of the present invention is a composition for cleaning a gelatin encapsulated product having a gelatin outer shell, the composition comprising, by weight, about 70 to 99.9 percent of a water-soluble alcohol, about 0.1 to 30 percent water, about 0.1 to 10 percent of a volatile silicone, and about 0.1 to 1 percent of a non-volatile silicone, wherein the composition prevents excessive swelling of the gelatin outer shell of the gelatin encapsulated product until after a minimum period of contact time has elapsed to allow the composition to sufficiently clean the gelatin encapsulated product. The alcohol is preferably selected from the group consisting of a C1–C4 alcohol or a combination of C1–C4 alcohols, such as methanol, ethanol, and iso-propanol. Additional components may be included such as preservatives, fragrances, and solvents.

Another aspect of the present invention is a method for cleaning a gelatin encapsulated product having a gelatin outer shell, the method comprising the steps of contacting the gelatin encapsulated product with a cleaning composition for a sufficient period of time to sufficiently reduce the amount of contaminants on the gelatin outer shell of the gelatin encapsulated product to allow the gelatin encapsulated product to be used for its intended use, the cleaning composition comprising, by weight about 70 to 99.9 percent of a water-soluble alcohol, about 0.1 to 30 percent water, about 0.1 to 10 percent of a volatile silicone, and about 0.1 to 1 percent of a non-volatile silicone, separating the gelatin encapsulated product from the cleaner, and drying the gelatin encapsulated product. The gelatin capsule may be a paint ball.

Still another aspect of the present invention is a method for cleaning a gelatin encapsulated product having a gelatin outer shell, the method comprising the steps of placing one or more gelatin encapsulated products in a porous holding container, placing the holding container in a larger non-porous mixing container containing a sufficient amount of a cleaning composition to cover the gelatin encapsulated products, the cleaning composition comprising, by weight, about 70 to 99.9 percent of a water-soluble alcohol, about 0.1 to 30 percent water, about 0.1 to 10 percent of a volatile silicone, and about 0.1 to 1 percent of a non-volatile silicone, contacting the gelatin encapsulated products with the cleaner for a sufficient period of time to sufficiently reduce the amount of contaminants on the gelatin outer shells of the gelatin encapsulated products to allow the gelatin encapsulated products to be used for their intended use, and removing the holding container from the mixing container, thereby removing the gelatin encapsulated products from the composition. This aspect of the present invention may further include the step of drying the gelatin encapsulated products using ambient passive or forced air. The gelatin encapsulated products may be paint balls.

Still another aspect of the present invention is a concentrated composition for cleaning a gelatin encapsulated product having a gelatin outer shell, the concentrated composition consisting essentially of, by weight, about 70 to 99.9 percent of a water-soluble alcohol, about 0.1 to 10 percent of a volatile silicone, and about 0.1 to 1 percent of a non-volatile silicone. This aspect of the present invention may further comprise at least one preservative.

Yet another aspect of the present invention is a composition for cleaning a gelatin encapsulated product having a gelatin outer shell, the concentrate comprising, by weight, about 70 to 99.9 percent of a water-soluble alcohol selected from the group consisting of a C1–C4 alcohol or a combination of C1–C4 alcohols, about 0.1 to 30 percent water, about 0.1 to 10 percent of a volatile silicone selected from the group consisting of cyclomethicone, dimethicone, and, and about 0.1 to 1 percent of a non-volatile silicone selected from the group consisting of linear and non linear siloxane polymers, cyclo siloxane polymers, and block siloxane copolymers, wherein the composition prevents excessive swelling of the gelatin outer shell of the gelatin encapsulated product until after a minimum period of contact time has elapsed to allow the concentration to sufficiently clean the gelatin encapsulated product.

These and other features, objects and advantages of the present invention will be in part apparent to those skilled in art and in part pointed out hereinafter.

DETAILED DESCRIPTION OF THE INVENTION

Figure 10:
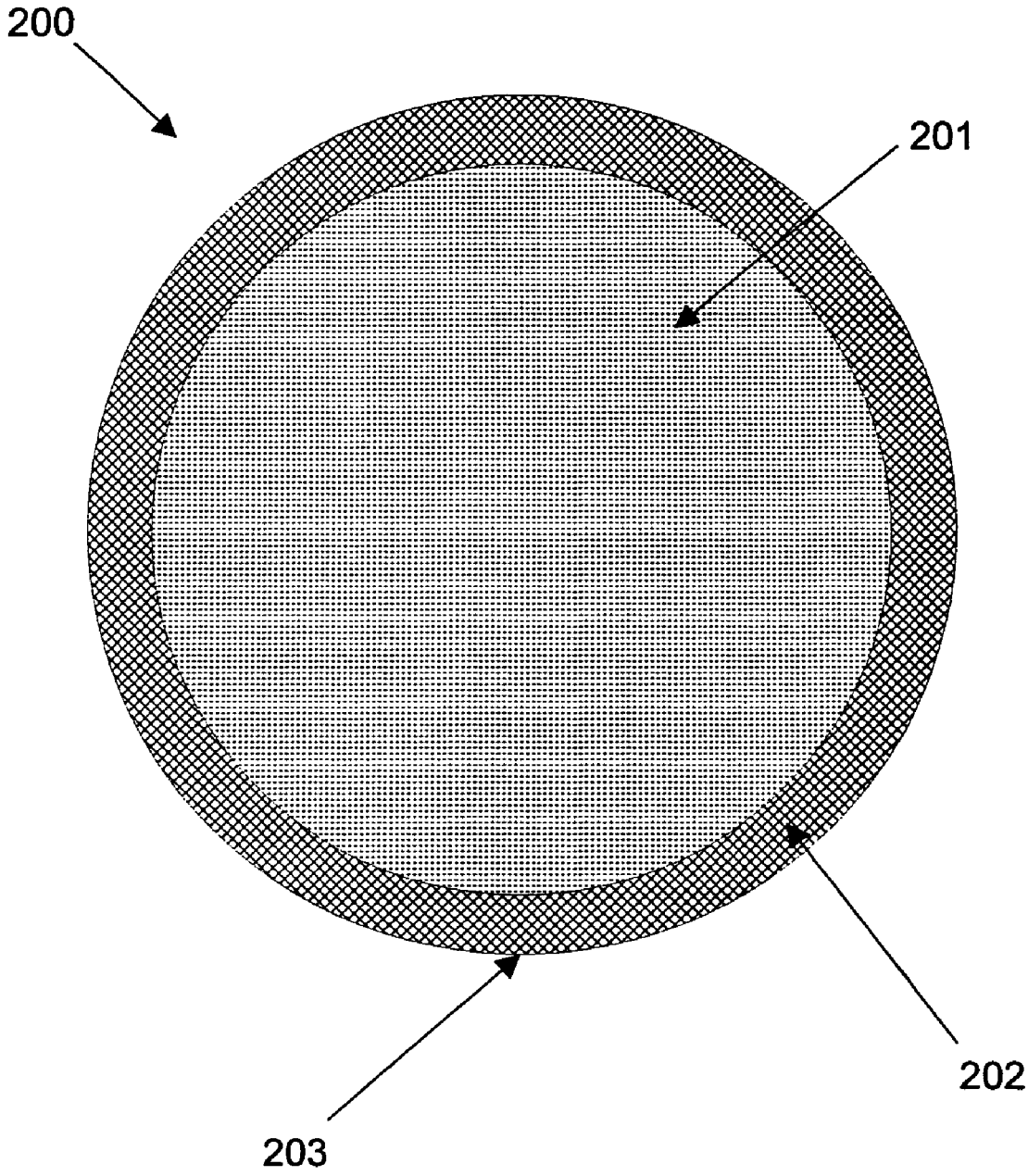
FIG. 10 (PRIOR ART)
FIG. 10 is a generalized cross-sectional view of a gelatin encapsulated product.

As shown in FIG. 10, the present invention relates to a cleaning composition and method for cleaning a gelatin encapsulated product 200 consisting of a product 201 surrounded by a gelatin outer shell 202. The composition preferably comprises, by weight, about 70 to 99.9 percent of a water-soluble alcohol, about 0.1 to 30 percent water, about 0.1 to 10 percent of a volatile silicone, and about 0.1 to 1 percent of a non-volatile silicone, wherein the composition 100 prevents excessive swelling of the gelatin outer shell of the gelatin encapsulated product 200 until after a minimum period of contact time has elapsed to allow the composition to sufficiently clean the gelatin encapsulated product 200.

The primary component in the composition is a water-soluble alcohol. While the amount of alcohol in the composition is preferable between about 70 to 99.9 percent, one skilled in the art would appreciate that any suitable percentage of alcohol may be used. For example, a composition consisting of 65 percent of a water-soluble alcohol may function in an acceptable manner similar to a composition comprised of 70 percent of a water-soluble alcohol. However, in order to achieve the most desirable results, it is preferred that the percentage of water-soluble alcohols be between approximately 70 percent and 99.9 percent, by weight.

While any suitable alcohol may be used, the water-soluble alcohol is preferably selected from the group consisting of a $C_1$–$C_4$ alcohol or a combination of $C_1$–$C_4$ alcohols. The $C_1$–$C_4$ alcohols are shown below.

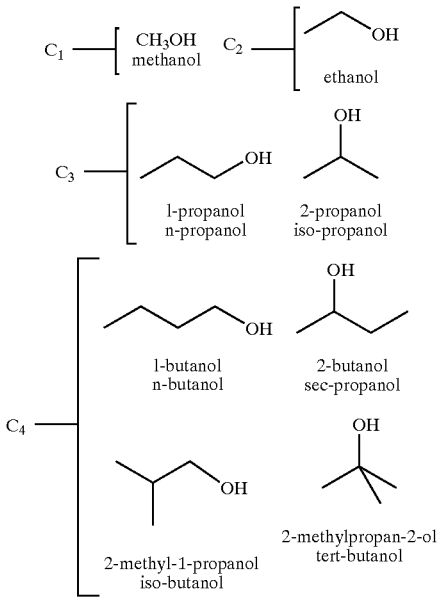

Further still, the C1–C4 alcohol is more preferably selected from the group consisting of methanol, ethanol, and iso-propanol. While any of the C1–C4 alcohols may be used, the most preferred alcohol to be used is ethanol.

Because a composition of the invention is comprised primarily of a water-soluble alcohol, the composition will not degrade the gelatin shell of the gelatin encapsulated product as significantly as a water-based cleaner would. For example, a simple detergent, such as dish soap, diluted with water would be much more likely to cause the gelatin shell of the gelatin encapsulated products to swell and become degraded than the composition of the present invention. Additionally, alcohol based cleaners are more advantageous than other cleaners because of their volatility. This is beneficial because, after cleaning the gelatin capsules, it is preferable for the gelatin capsules be dried as rapidly as possible after being removed from contact with the cleaning composition to minimize the amount of swelling to the gelatin encapsulated product. Once cleaned, the gelatin encapsulated products should be dried to avoid any adverse swelling of the gelatin shells. Swollen gelatin encapsulated products may not be able to be used for their intended purposes.

The amount of swell should be small enough to enable the gelatin encapsulated products to retain their suitability for use for their intended purpose. In general, gelatin encapsulated products should swell less than 10 percent, resulting in an increase in diameter of less than 10 percent, as a consequence of their contact with the cleaning composition. However, the amount of swell of the gelatin encapsulated product is preferably less than 5 percent, more preferably less than 1 percent, and most preferably less than 0.5 percent.

When the gelatin encapsulated products are paint balls, the amount of acceptable swell is not based on the percentage increase in diameter, but rather on the caliber of the paint balls. Paint balls are classified by their diameter, or caliber, and are sized appropriately to fit within the barrel of a paint ball gun of the same caliber. For example, a 68-caliber paint ball gun is sized to shoot 68-caliber paint balls. Thus, the amount of acceptable swell for a 68-caliber paint ball is the amount of swell that can occur without preventing the paint ball from being shot from a 68-caliber paint ball gun. Because there is only a slight tolerance for swell within the barrel of a paint ball gun, the degree of acceptable swell for a paintball is the amount of swell that can occur without the paint ball changing its caliber. Thus, the swell of a 68-caliber paint ball is acceptable provided the diameter of the paintball remains within the range of diameters of 68-caliber paint balls. Paintballs come in a variety of calibers, for example, 68-caliber and 40-caliber.

The composition further comprises about 0.1 to 30.0 percent water. While the amount of water in the composition is preferable between about 0.1 to 30.0 percent, one skilled in the art would appreciate that any suitable percentage of water may be satisfactorily used. For example, a composition containing 5 percent water may function in an acceptable manner. However, given the water-soluble properties of gelatin encapsulated products, it is important to keep the percentage of water in the composition reasonable low. In order to achieve the most desirable results, it is preferred that the percentage of water be less than about 30.0 percent, by weight.

The water used in the composition may be water from municipal water supplies or higher quality water. Under ideal conditions, the water used in the composition according to the preferred embodiment would be high quality water. High quality water is water with minimal amounts of impurities and is typically purified by various methods such as UV-irradiation, micro filtration, reverse osmosis, ion-exchange separation, activated carbon treatment, and other specialized purification steps.

The composition also includes one or more volatile silicones in the amount of 0.1 to 10 percent of the composition, by weight. Volatile silicones are silicones which are readily passed off by evaporation at ambient temperatures. Such volatile silicones include, for example, cyclomethicone and dimethicone. Mixtures of volatile silicones may also be used. As described above, one skilled in the art will recognize and appreciate that slight variations in the weight percentage of volatile silicones in the composition may yield acceptable and desirable results. Thus, while the preferred amount of volatile silicones in the composition ranges from about 0.1 to about 10 weight percent, any acceptable amount of volatile silicone may be used.

In addition to the volatile silicones described above, the composition also includes one or more non-volatile silicones in the amount of about 0.1 to 1 weight percent. However, one of ordinary skill in the art will appreciate that the amount of non-volatile silicone may be outside of this range while achieving satisfactory results, for example, in the amount of 2 weight percent. The non-volatile silicones are preferably selected from the group consisting of linear and non linear siloxane polymers, cyclo siloxane polymers, block siloxane copolymers, and mixtures thereof.

The inclusion of volatile and non-volatile silicones in the composition of the invention allows the composition to coat the gelatin capsule or gelatin encapsulated product. When the gelatin encapsulated products to which the composition or method of the present invention is applied are paint balls, the silicone coating substantially improves their performance. For example, the silicone coating increases the slickness of the surface of the paint balls and reduces the chances that the paint balls will become stuck together. When an automatic feeder is used to feed the paint balls to the paint ball gun, the silicone coating will facilitate the rapid feeding of the paint balls and drastically reduces the possibility that one of the paint balls will become stuck in the automatic feeder. Additionally, the paint balls that are coated with silicone will slide through the barrel of the paint ball gun more smoothly, thereby potentially increasing their velocity and accuracy.

In addition to the components described above, the composition may further include one or more preservatives, such as benzyl alcohol, methyl paraben, and ethyl paraben. The addition of preservatives to the composition preserves the composition upon storage and reuse.

Moreover, the composition may include other additives to enhance the gelatin encapsulated products to improve the smell, taste, and slip of the capsules. These additives may include alcohol-based fragrances.

When applying the composition to gelatin encapsulated products according to the present invention, the composition is preferably in contact with the gelatin encapsulated products in slight excess of a sufficient minimum period of time to allow the composition to sufficiently clean the gelatin encapsulated product. The sufficient period of time can be virtually instantaneous or may be for a prolonged period of time. The gelatin capsules may also be actively or passively allowed to incubate within the cleaning composition. A typical range for exposure is between 10 seconds and 24 hours. For example, the sufficient minimum period of time may be approximately 30 seconds, during which time the gelatin encapsulated products are maintained in contact with the composition, for example, by submersing the gelatin encapsulated products in the cleaning composition. Unless the minimum period of time is excessive, for example, greater than 24 hours, the composition will not cause the gelatin outer shell of the gelatin encapsulated product to swell excessively.

According to another embodiment of the present invention, the composition for cleaning a gelatin encapsulated product having a gelatin outer shell may comprise, by weight, about 70 to 99.9 percent of a water-soluble alcohol selected from the group consisting of a C1–C4 alcohol or a combination of C1–C4 alcohols, about 0.1 to 30 percent water, about 0.1 to 10 percent of a volatile silicone selected from the group consisting of cyclomethicone, dimethicone, and about 0.1 to 1 percent of a non-volatile silicone selected from the group consisting of linear and non linear siloxane polymers, cyclo siloxane polymers, and block siloxane copolymers, wherein the composition prevents excessive swelling of the gelatin outer shell of the gelatin encapsulated product until after a minimum period of contact time has elapsed to allow the concentration to sufficiently clean the gelatin encapsulated product.

In addition to the compositions described above, the invention also pertains to a concentrated form of the composition. In particular, the present invention also relates to a concentrated composition for cleaning a gelatin encapsulated product having a gelatin outer shell, the concentrated composition consisting essentially of, by weight, about 70 to 99.9 percent of a water-soluble alcohol, about 0.1 to 10 percent of a volatile silicone, and about 0.1 to 1 percent of a non-volatile silicone. Although it would be fully diluted for use, the concentrate may also contain a small amount of water, typically in the amount of about 1 to 10 weight percent. Each of the components of the concentrate have been discussed above with reference to the composition. The concentrate may also contain those optional constituents discussed above.

Figure 1:
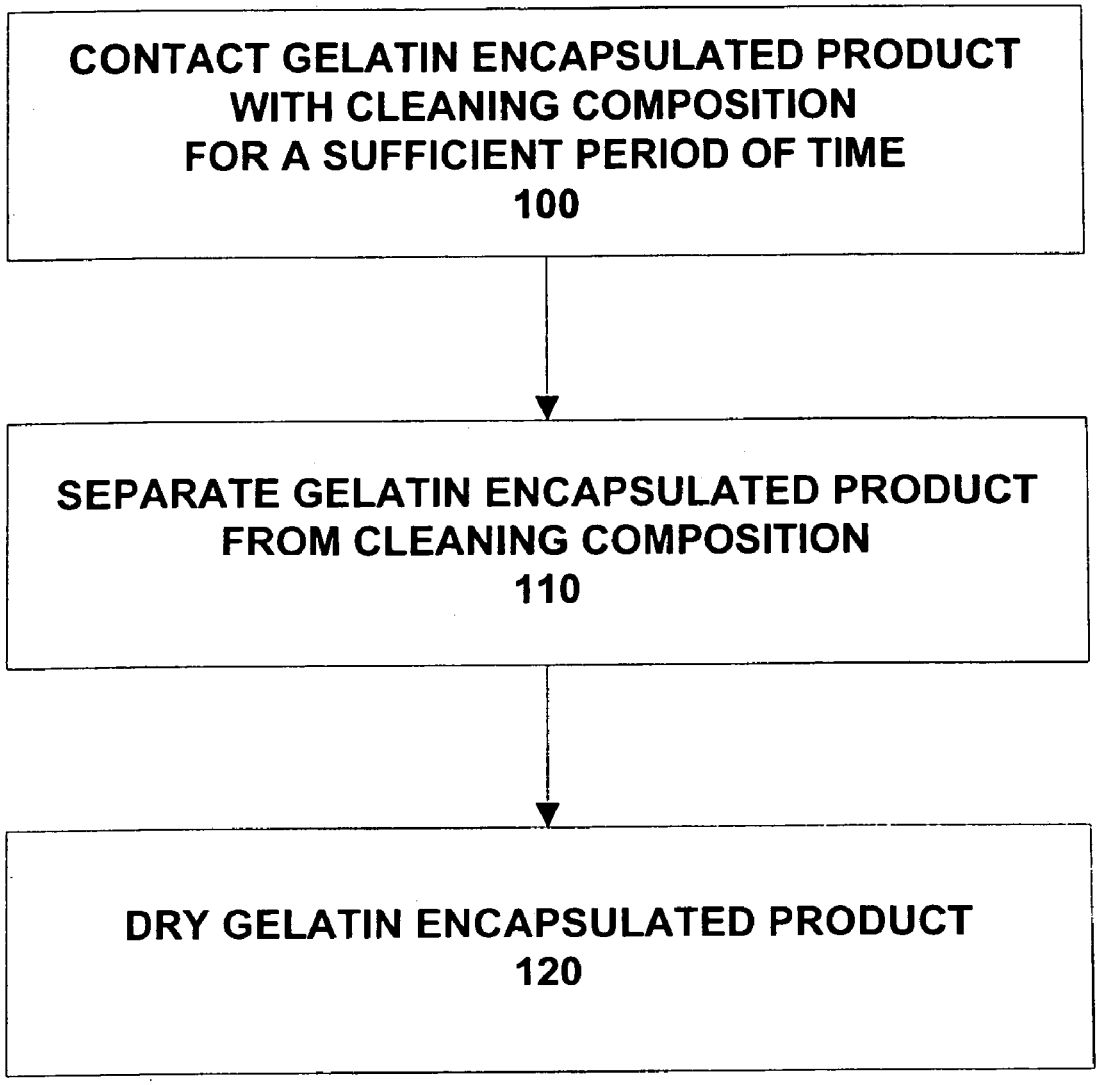
FIG. 1 is a flowchart showing a step-by-step method of cleaning gelatin encapsulated products according to one embodiment of the present invention.
Figure 2:
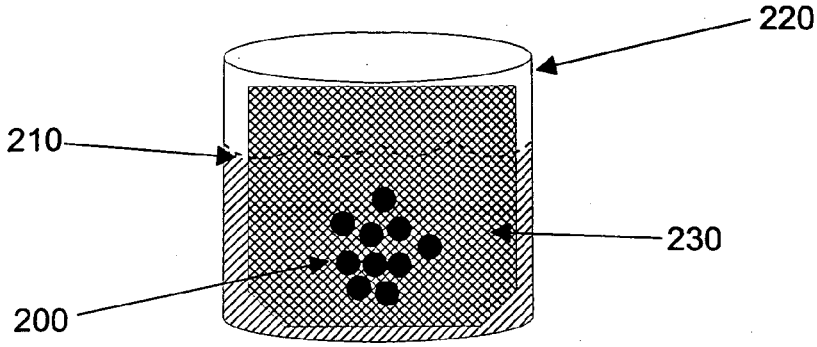
FIG. 2 is a diagram showing the first step of the method shown in FIG. 1.
Figure 3:
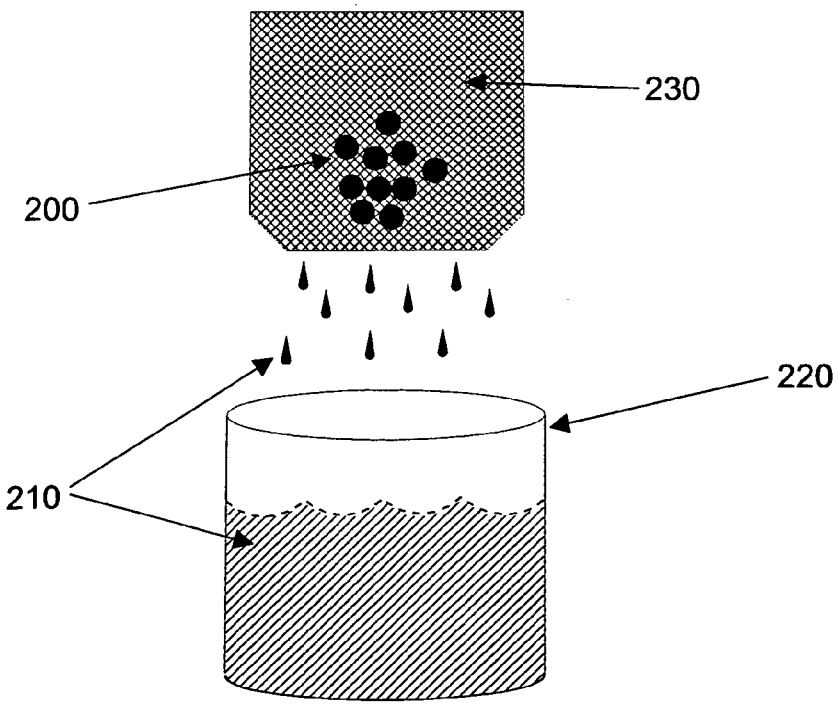
FIG. 3 is a diagram showing the second and third steps of the method shown in FIG. 1.

FIGS. 1–3 depict methods of cleaning a gelatin encapsulated product 200 according to the invention. A gelatin encapsulated product 200 typically consists of a product 201 encased within a gelatin outer shell 202 having a gelatin surface 203. (See FIG. 10). As discussed above, the product 201 may be of many different formulations depending on the intended uses of the gelatin encapsulate product 200.

Referring now to FIG. 1, the first step of a method according to the invention comprises contacting a gelatin encapsulated product with a cleaning composition for a sufficient period of time to remove contaminants from the gelatin outer shell of the gelatin encapsulated product while still allowing the gelatin encapsulated product to be used for its intended use. The cleaning composition comprises, by weight, about 70 to 99.9 percent of a water-soluble alcohol, about 0.1 to 30 percent water, about 0.1 to 10 percent of a volatile silicone, and about 0.1 to 1 percent of a non-volatile silicone. The gelatin encapsulated product is then separated the gelatin encapsulated product from the cleaner, and dried.

The first step 100 is to contact the gelatin encapsulated product with a cleaning composition for a sufficient period of time to remove contaminants. As shown in FIG. 2, one possible way to contact the gelatin encapsulated products 200 with the cleaning composition 210 is to submerge the gelatin encapsulated products 200 in a container 220 with a sufficient amount of the composition 210 to contact each of the gelatin encapsulated products 200. An acceptable level of contact may be achieved by soaking, mixing, stirring, shaking, or any other known method. In order to facilitate the cleaning process, the gelatin encapsulated products may be placed within a porous holding container 230. Holding container 230 serves to hold the gelatin encapsulated products 200 in an organized manner while allowing the gelatin encapsulated products 200 to be sufficient contacted by composition 210. Porous holding containers which may be used include, for example, mesh materials, a net, a bag, or a basket.

The sufficient period of time is the minimum amount of time required to sufficiently remove an amount of contaminants on the gelatin outer shell 202 of the gelatin encapsulated product 200 to allow the gelatin encapsulated product 200 to be used for its intended use. For example, in the case where the gelatin encapsulated product 200 is a paint ball, the period of time is the amount of time required to remove enough contaminants, such as paint, from the gelatin outer shell 202 of the paint ball to allow the paint ball to be shot from a paint ball gun. Furthermore, different users of the paint balls may prefer to have the paint balls have different degrees of cleanliness, for example, for increased accuracy when the paint ball is shot from a paint ball gun. The sufficient period of time required to remove contaminants may vary by user and by the intended purpose of the gelatin encapsulated product. However, a typical period of time in between 10 seconds and 24 hours.

The second step 110 is to separate the gelatin encapsulated product 200 from the cleaner 210. As described above, the water-soluble properties of gelatin encapsulated products makes it necessary to separate the gelatin encapsulated products 200 from the cleaning composition 210 before the gelatin shell swells excessively, for example, by more than 10 percent, or dissolves. Thus, after the gelatin encapsulated product 200 is maintained in contact with the composition 210 for a sufficient period of time, for example, 10 seconds to 24 hours, the gelatin encapsulated products 200 are separated from the composition 210.

According to step 110, and as shown in FIG. 3, the gelatin encapsulated products 200 are preferably removed from mixing container 220 containing composition 210 with a holding container 230. However, the holding container 230 is not required. For example, the gelatin encapsulated products could be placed directly in the mixing container 220 with the cleaning composition. In this case, when the sufficient period of contact time had elapsed, the gelatin encapsulated products 200 could be scooped out of mixing container 220, mixing container 220 could be drained, or the composition 210 could be poured out of the mixing container 220. While the preferred method includes the use of a holding container, one of ordinary skill in the art would appreciate that any other method achieving the same end result would be acceptable.

The third step 120 consists of drying the gelatin encapsulated product. As shown in FIG. 2, after the gelatin encapsulated products 200 are separated from the cleaning composition 210, the gelatin encapsulated products 200 are dried. Droplets of composition 210 are illustrated in FIG. 2 to convey that one acceptable method of drying the gelatin encapsulated products 200 is to allow them to drip dry. This is yet another advantage of using holding container 230. Other acceptable methods of drying may be used, for example, air drying and hand drying with a towel.

The method illustrated in FIGS. 1–3 may be applied to any type of gelatin encapsulated product. As mentioned above, one possible type of gelatin encapsulated product to which the present invention is readily applicable is a paint ball. Other possible gelatin encapsulated products include pharmaceutical capsules such as oral capsules, for example.

Another embodiment of the present invention relates to a second method for cleaning a gelatin encapsulated product 200 having a gelatin outer shell 202. (See FIG. 10). As shown in FIGS. 4–7, the method comprises the steps of placing one or more gelatin encapsulated products in a porous holding container, placing the holding container in a larger non-porous mixing container containing a sufficient amount of a cleaning composition to cover the gelatin encapsulated products, the cleaning composition comprising, by weight, about 70 to 99.9 percent of a water-soluble alcohol, about 0.1 to 30 percent water, about 0.1 to 10 percent of a volatile silicone, and about 0.1 to 1 percent of a non-volatile silicone, contacting the gelatin encapsulated products with the cleaner for a sufficient period of time to sufficiently reduce the amount of contaminants on the gelatin outer shells of the gelatin encapsulated products to allow the gelatin encapsulated products to be used for their intended use, and removing the holding container from the mixing container, thereby removing the gelatin encapsulated products from the composition.

Figure 4:
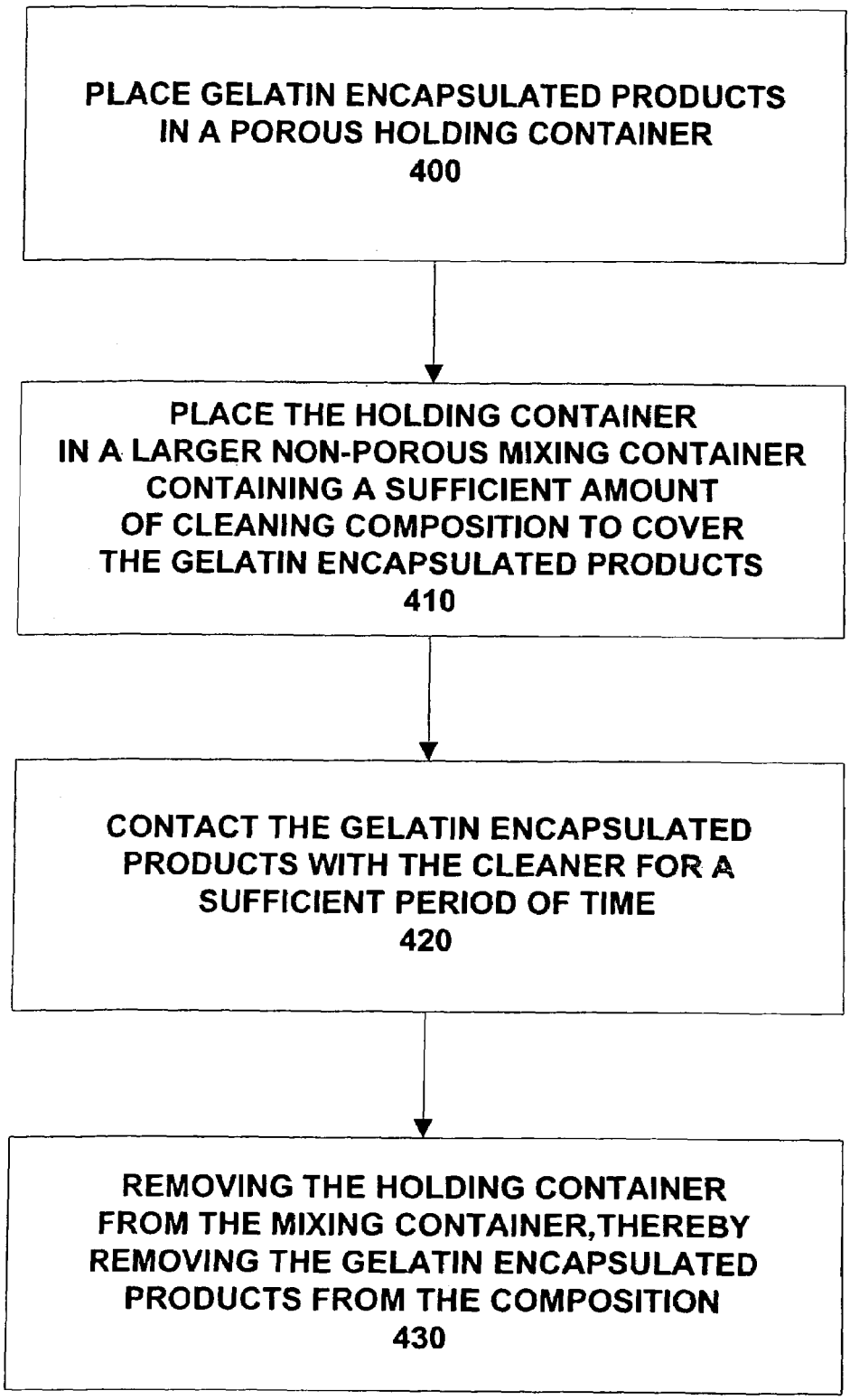
FIG. 4 is a flowchart showing a step-by-step method of cleaning gelatin encapsulated products according to another embodiment of the present invention.
Figure 5:
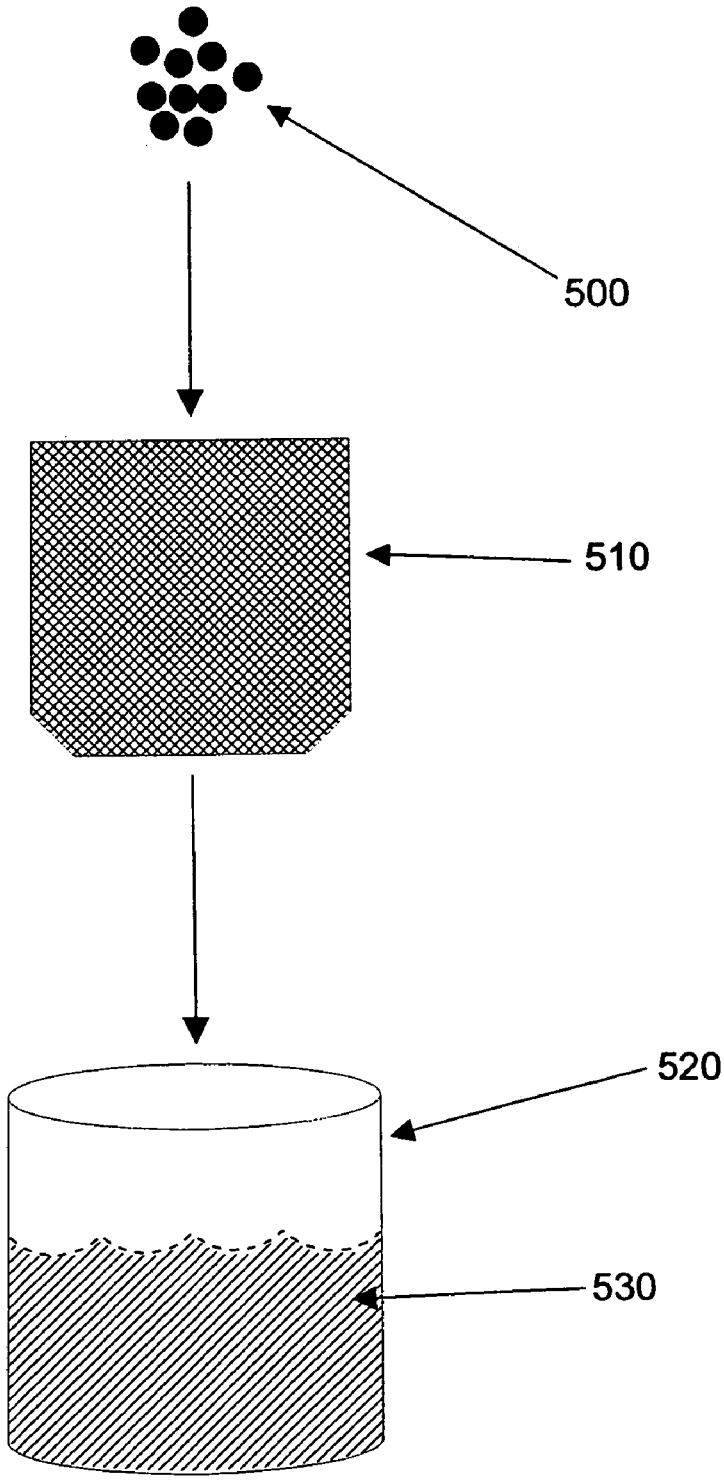
FIG. 5 is a diagram showing the first and second steps of the method shown in FIG. 4.

As shown in FIGS. 4 and 5, the first step 400 preferably consists of placing one or more gelatin encapsulated products 500 in a porous holding container 510. Holding container 510 is preferably sufficiently porous to allow items smaller than gelatin encapsulated products 500 to pass through the side of holding container 510 unimpeded. Holding container 510 may be formed of a mesh material, a net, a bag, or a basket. Each of these exemplary materials would allow composition 530 to pass into holding container 510 into contact with the gelatin encapsulated products 500, and pass out of holding container 510, carrying along with it any contaminations cleaned from the gelatin encapsulated products 500. While, soft-sided holding containers such as nets or bags have advantages over hard-sided holding containers because of their flexibility and compressibility for storage and the like, any type of suitably porous holding container may be used.

The second step 410 consists of placing holding container 510 in a larger non-porous mixing container 520 containing a sufficient amount of a cleaning composition 530 to cover the gelatin encapsulated products 500. Mixing container 520 can be any suitable container, for example, a bucket.

Figure 6:
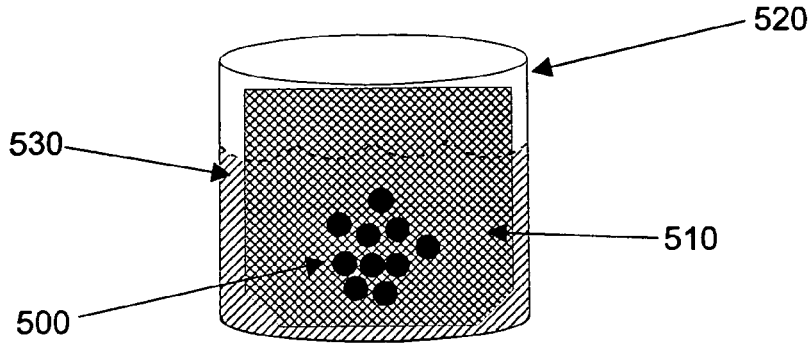
FIG. 6 is a diagram showing the third step of the method shown in FIG. 4.

As shown in FIGS. 4 and 6, the third step 420 consists of contacting gelatin encapsulated products 500 with cleaner 530 for a sufficient period of time to sufficiently reduce the amount of contaminants on the gelatin outer shells 202 (FIG. 10) of the gelatin encapsulated products 500 to allow the gelatin encapsulated products 500 to be used for their intended use. As stated above, the sufficient period of time is the minimum amount of time required to sufficiently reduce the amount of contaminants on the gelatin outer shell 202 of the gelatin encapsulated product 500 to allow the gelatin encapsulated product 500 to be used for its intended use, for example, 10 seconds to 24 hours. Furthermore, the sufficient period of time required to reduce the amount of contaminants may vary by user and by the intended purpose of the gelatin encapsulated product.

Figure 7:
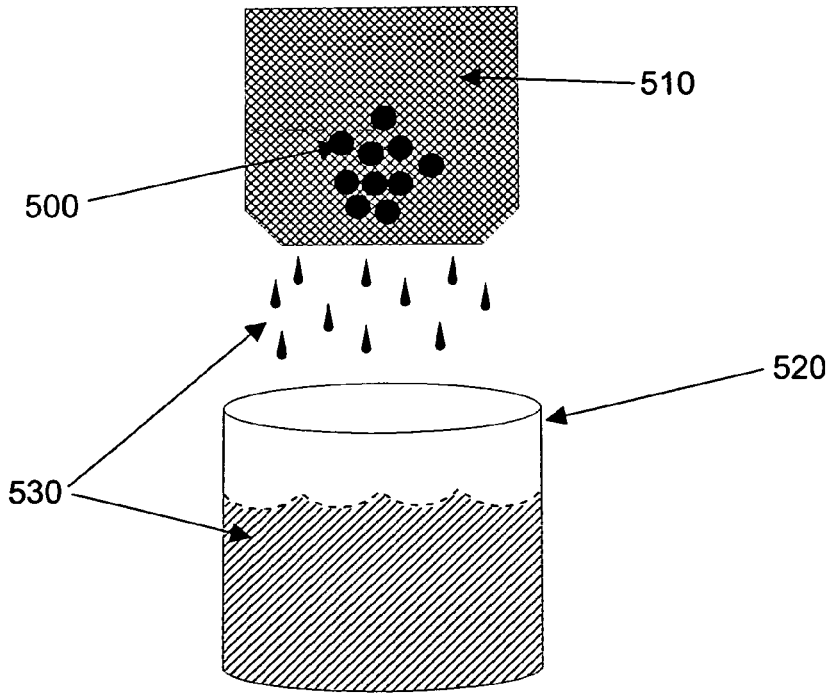
FIG. 7 is a diagram showing the fourth step of the method shown in FIG. 4.

As shown in FIGS. 4 and 7, the fourth step 430 consists of removing holding container 510 from mixing container 520, thereby removing gelatin encapsulated products 500 from the composition 530. As described above, after gelatin encapsulated products 500 have been in contact with cleaning composition 530 for a sufficient period of time, it is necessary to remove the gelatin encapsulated products from the composition to prevent the composition from having undesirable effects, such as incurring swelling of the gelatin shells of the gelatin encapsulated products. This removal may be effected by any suitable method. FIG. 7 depicts the removal of the gelatin encapsulated products with a holding container 510 such as a strainer of some type. However, holding container 510 may take any suitable form.

Figure 8:
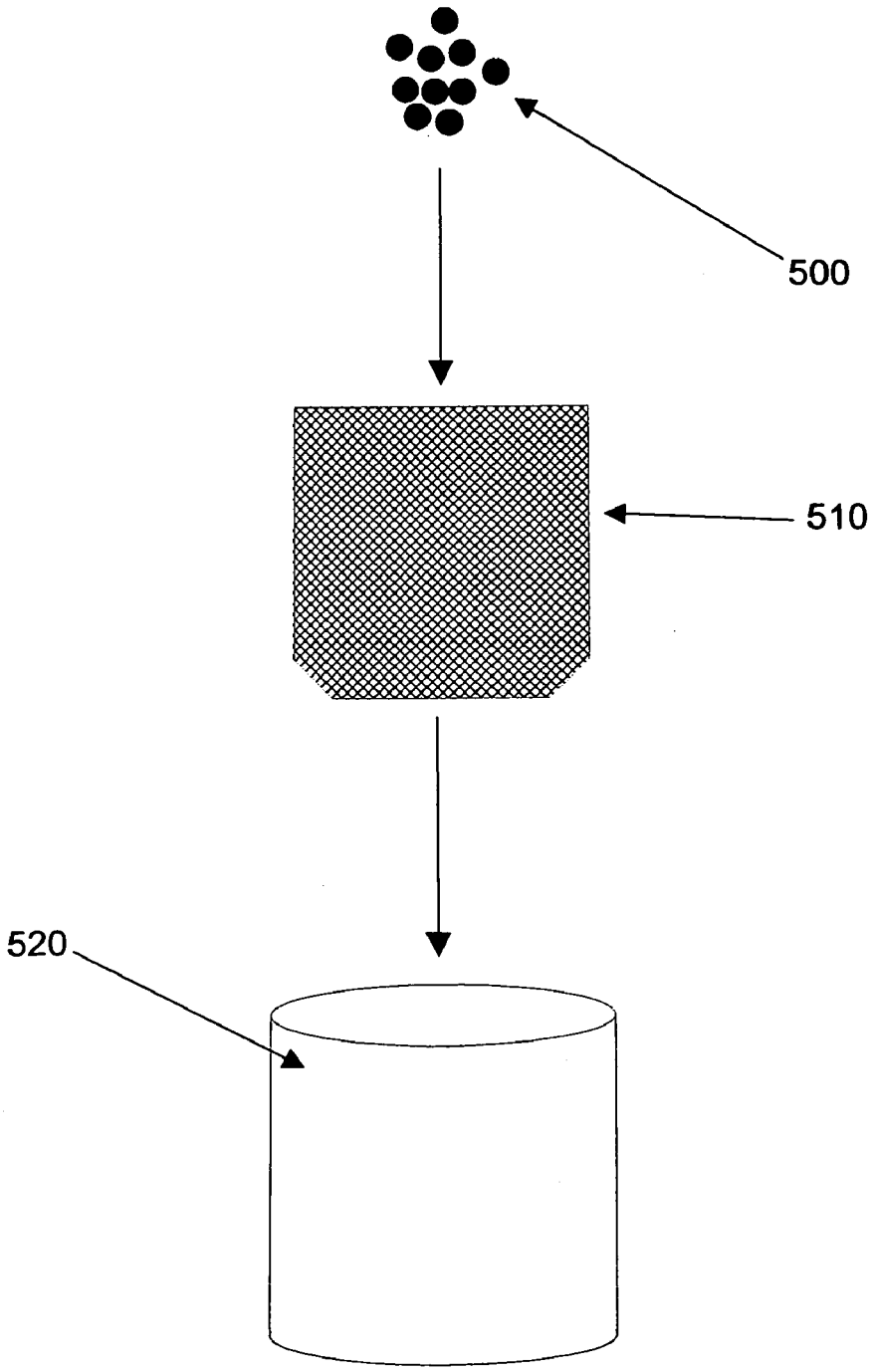
FIG. 8 is a diagram showing the first steps of an alternative third method of the present invention.
Figure 9:
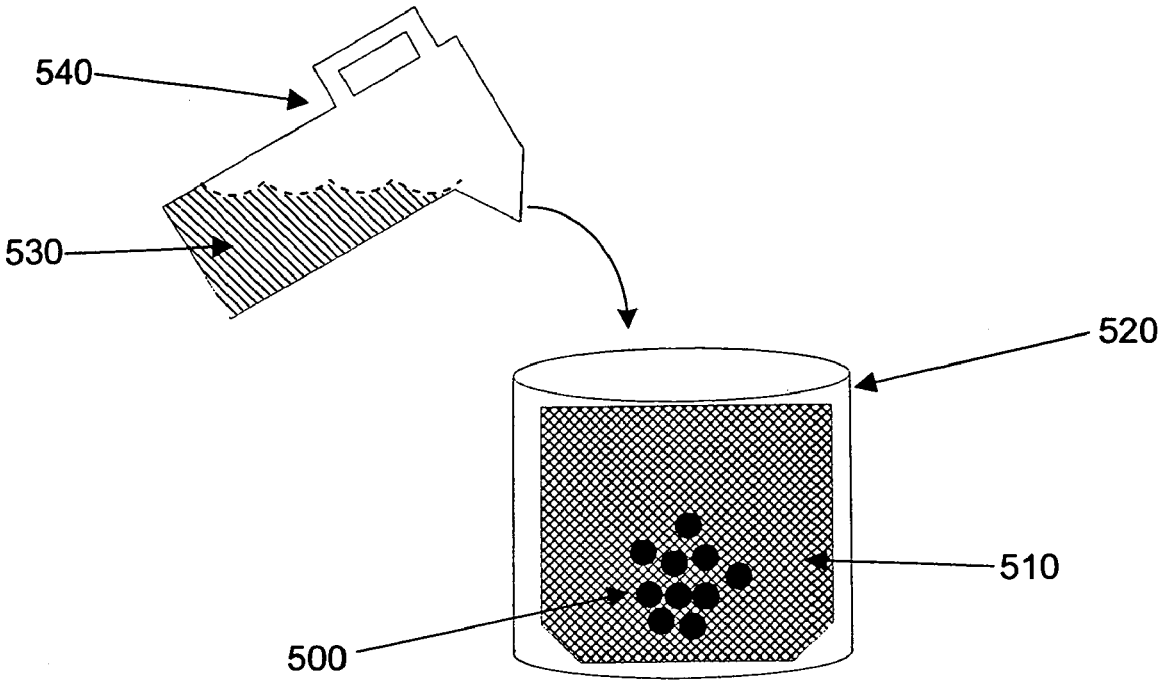
FIG. 9 is a diagram showing the next step of the alternative third method shown in FIG. 8.

The above method according to the present invention may also be modified as appropriate, for example, to include a step of drying the gelatin encapsulated products. Furthermore, as shown in FIGS. 8 and 9, the method may be altered to comprise the steps of placing the gelatin encapsulated products 500 in mixing container 510, which is then placed within holding container 520. After this occurs, cleaning composition 530 can be added to holding container 520 in any suitable way, for example, by being poured into holding container 520 from pitcher 540 or any other storage device. The amount of composition 530 added may vary, but is preferably a sufficient amount to cover gelatin encapsulated products 500 with composition 530.

The invention claimed is:

1. A composition for cleaning a gelatin encapsulated product having a gelatin outer shell, the composition comprising, by weight:

about 70 to 99.9 percent of a water-soluble alcohol;

about 0.1 to 30 percent water;

about 0.1 to 10 percent of a volatile silicone; and about 0.1 to 1 percent of a non-volatile silicone, wherein said composition prevents excessive swelling of the gelatin outer shell of the gelatin encapsulated product until after a minimum period of contact time has elapsed to allow said composition to sufficiently clean the gelatin encapsulated product and wherein excessive swelling means an increase in the diameter of the gelatin outer shell of the gelatin encapsulated product in excess of 10 percent.

2. The composition of claim 1 wherein said alcohol is selected from the group consisting of a $C_1$–$C_4$ alcohol or a combination of $C_1$–$C_4$ alcohols.

3. The composition of claim 2 wherein said alcohol is selected from the group consisting of methanol, ethanol, and iso-propanol.

4. The composition of claim 3 wherein said alcohol is ethanol.

5. The composition of claim 1 wherein said volatile silicone is selected from the group consisting of cyclomethicone and dimethicone.

6. The composition of claim 1 wherein said non-volatile silicone is selected from the group consisting of linear and non linear siloxane polymers, cyclo siloxane polymers, and block siloxane copolymers.

7. The composition of claim 1 further comprising at least one preservative.

8. The composition of claim 7 wherein said at least one preservative is selected from the group consisting of benzyl alcohol, methyl paraben, and ethyl paraben.

9. The composition of claim 1 further comprising a fragrance.

10. The composition of claim 9 wherein said fragrance is an alcohol-based fragrance.

11. The composition of claim 1 wherein said water is purified water.

12. A method for cleaning a gelatin encapsulated product having a gelatin outer shell, the method comprising the steps of:

contacting the gelatin encapsulated product with a cleaning composition for a sufficient period of time to sufficiently reduce the amount of contaminants on the gelatin outer shell of the gelatin encapsulated product to allow the gelatin encapsulated product to be used for its intended use, the cleaning composition comprising, by weight:

about 70 to 99.9 percent of a water-soluble alcohol;

about 0.1 to 30 percent water;

about 0.1 to 10 percent of a volatile silicone; and about 0.1 to 1 percent of a non-volatile silicone, separating the gelatin encapsulated product from the cleaner; and drying the gelatin encapsulated product.

13. The method of claim 12 wherein the gelatin encapsulated product is a paint ball.

14. The composition of claim 12 wherein said alcohol is selected from the group consisting of a $C_1$–$C_4$ alcohol or a combination of –$C_1$–$C_4$ alcohols.

15. The composition of claim 14 wherein said alcohol is selected from the group consisting of methanol, ethanol, and iso-propanol.

16. A method for cleaning a gelatin encapsulated product having a gelatin outer shell, the method comprising the steps of:

placing one or more gelatin encapsulated products in a porous holding container;

placing said holding container in a larger non-porous mixing container containing a sufficient amount of a cleaning composition to cover the gelatin encapsulated products, the cleaning composition comprising, by weight:

about 70 to 99.9 percent of a water-soluble alcohol;

about 0.1 to 30 percent water;

about 0.1 to 10 percent of a volatile silicone; and about 0.1 to 1 percent of a non-volatile silicone;

contacting the gelatin encapsulated products with said cleaner for a sufficient period of time to sufficiently reduce the amount of contaminants on the gelatin outer shells of the gelatin encapsulated products to allow the gelatin encapsulated products to be used for their intended use; and removing said holding container from said mixing container, thereby removing the gelatin encapsulated products from the composition.

17. The method of claim 16 further comprising the step of drying the gelatin encapsulated products.

18. The method of claim 16 wherein the cleaner is added to said mixing container after said holding container is placed within said mixing container.

19. The method of claim 16 wherein said holding container is formed of a mesh material.

20. The method of claim 16 wherein said holding container is a net.

21. The method of claim 16 wherein said holding container is a bag.

22. The method of claim 16 wherein said holding container is a basket.

23. The method of claim 16 wherein said mixing container is a bucket.

24. The method of claim 16 wherein the gelatin encapsulated products are paint balls.

25. A concentrated composition for cleaning a gelatin encapsulated product having a gelatin outer shell, the concentrated composition consisting essentially of, by weight:

about 70 to 99.9 percent of a water-soluble alcohol;

about 0.1 to 10 percent of a volatile silicone; and about 0.1 to 1 percent of a non-volatile silicone.

26. The concentrated composition of claim 25 further comprising at least one preservative, wherein said preservative is selected from the group consisting of benzyl alcohol, methyl paraben, and ethyl paraben, said alcohol is selected from the group consisting of $C_1$–$C_4$ alcohols or a mixture of –$C_1$–$C_4$ alcohols, said volatile silicone is selected from the group consisting of cyclomethicone and dimethicone, and said nonvolatile silicone is selected from the group consisting of linear and non linear siloxane polymers, cyclo siloxane polymers, and block siloxane copolymers.

27. A composition for cleaning a gelatin encapsulated product having a gelatin outer shell, the composition comprising, by weight:

about 70 to 99.9 percent of a water-soluble alcohol selected from the group consisting of a $C_1$–$C_4$ alcohol or a combination of $C_1$–$C_4$ alcohols;

about 0.1 to 30 percent water;

about 0.1 to 10 percent of a volatile silicone selected from the group consisting of cyclomethicone and dimethicone, and about 0.1 to 1 percent of a non-volatile silicone selected from the group consisting of linear and non linear siloxane polymers, cyclo siloxane polymers, and block siloxane copolymers, wherein said composition prevents excessive swelling of the gelatin outer shell of the gelatin encapsulated product until after a minimum period of contact time has elapsed to allow said concentration to sufficiently clean the gelatin encapsulated product and wherein excessive swelling means an increase in the diameter of the gelatin outer shell of the gelatin encapsulated product in excess of 10 percent.

* * * * *